US005927519A

United States Patent [19]

Koonts et al.

[11] Patent Number: 5,927,519

[45] Date of Patent: Jul. 27, 1999

[54] GOLF EQUIPMENT SUPPORT RACK

[76] Inventors: Garland Wayne Koonts; Anna Ryan Koonts, both of 3001 N. King Hwy., Ste. 272, Myrtle Beach, S.C. 29577

[21] Appl. No.: 08/858,130

[22] Filed: May 19, 1997

[51] Int. Cl.[6] ..... A47F 5/00

[52] U.S. Cl. ..... 211/85.7; 211/90.01; 211/104; 248/96

[58] Field of Search ..... 211/71.01, 85.7, 211/104, 34, 37, 90.01; 248/96

[56] References Cited

U.S. PATENT DOCUMENTS

| | | | |
|---|---|---|---|
| D. 380,637 | 7/1997 | Funk | D6/552 |
| D. 392,486 | 3/1998 | Hsia | D6/552 |
| 859,454 | 7/1907 | Larsson . | |
| 3,295,474 | 1/1967 | Ornstein | 108/152 |
| 4,045,103 | 8/1977 | Paulino | 211/71.01 |
| 4,074,635 | 2/1978 | Stauble | 108/27 |
| 4,437,414 | 3/1984 | Brescia et al. | 108/134 |
| 5,025,935 | 6/1991 | Hadachek | 211/85.18 |
| 5,087,003 | 2/1992 | Montgomery | 248/96 |
| 5,191,978 | 3/1993 | Strader et al. | 206/315.2 |
| 5,199,581 | 4/1993 | Arnold | 211/106 |
| 5,381,738 | 1/1995 | Meyer | 108/42 |
| 5,497,891 | 3/1996 | Hannon | 211/71 |
| 5,551,579 | 9/1996 | Converse | 211/70.2 |

*Primary Examiner*—Robert W. Gibson, Jr.
*Attorney, Agent, or Firm*—Harleston Law Firm; Kathleen M. Harleston

[57] ABSTRACT

A wall-mounted rack, preferably made of wood, metal or plastic, for supporting golf bags and, optionally, other golf-related equipment is disclosed. The rack is made up of: 1) a backboard; to which is affixed at approximately a right angle, 2) a shelf, the shelf comprising one or more C-shaped cut-outs, each C-shaped cut-out being capable of accommodating a golf bag; and 3) one or more arms extending from the backboard and supporting the shelf. The rack has an optional golf-accessories holder on one end. The support arms on the rack are preferably collapsible, so that the shelf folds down approximately parallel to the backboard when the rack is not in use.

6 Claims, 3 Drawing Sheets

GOLF EQUIPMENT SUPPORT RACK

BACKGROUND OF THE INVENTION

1. Technical Field

The present invention relates to a golf equipment support rack, more particularly to a wall-mounted rack for supporting golf bags in an upright position or for stowing other golf accessories.

2. Background Art

Golf bags, though functional for holding and transporting a set of golf clubs, have a tendency to fall over when they are propped against a wall. When the bag falls over or is dropped on the ground, the golf clubs and other golf-related equipment, such as golf balls, bug repellent, and golf tees, often spill out of the bag onto the ground. Indoors, golf equipment, including golf clubs, golf bags, and golf shoes, can scuff up walls and clutter an area, posing an inconvenience and sometimes a safety hazard. Many golfers resort to leaving their golf bags in the trunk of their car, where further damage can occur to the golf clubs and other items in the car trunk. Golf clubs which sustain damage can be expensive to replace, particularly high quality clubs. Golf is a tremendously popular sport and many homes have several family members who golf. Various types of caddies and stands exist for holding golf bags and accessories, many of which are cumbersome, ineffective, expensive, and/or unsuitable for home use.

The present invention provides a novel rack for supporting golf bags and equipment, which is simple, attractive, inexpensive, and suitable for use in the home. It is a single, compact unit which can be easily transported and mounted on an inside or outside wall. It can be used for temporary or long term storage of golf equipment. The present invention is easy to use; the golf bag can easily be leaned against or removed from the C-shaped cut-out in the support rack. Golf shoes, golf tees, golf balls, and other golf equipment can easily be placed on the optional accessories holder.

Potential locations for the present support rack include the wall in a hall, entryway, utility room, or den of the family home or vacation condo, or in a hotel or motel room. This support rack can be mounted in a garage, or it can be used to display golf equipment in a golf shop. A support rack of durable material could be used in the golf cart loading and unloading area near a golf clubhouse for temporary support of golf bags. The present support rack can also be used in a clubhouse locker area for temporary support of golf bags and/or accessories until they can be stowed in a locker. It could also be used in motel suites situated near golf courses to accommodate guests' golf bags and golf-related equipment.

SUMMARY OF THE INVENTION

The present invention is directed to a wall-mounted rack for supporting golf bags and, optionally, other golf-related equipment. The rack comprises: 1) a backboard; to which is affixed at approximately a right angle, 2) a shelf, the shelf comprising one or more C-shaped cut-outs, each C-shaped cut-out being capable of accommodating a golf bag; and 3) one or more arms extending from the backboard and supporting the shelf. The rack of the present invention is preferably made of wood, metal or plastic and has an optional accessories holder on one end. The support arms are preferably collapsible, so that the shelf folds down approximately parallel to the backboard when the rack is not in use.

BRIEF DESCRIPTION OF THE DRAWINGS

A more complete understanding of the invention and its advantages will be apparent from the following detailed description taken in conjunction with the accompanying drawings, wherein.

DESCRIPTION OF THE PREFERRED EMBODIMENTS

Figure 1:
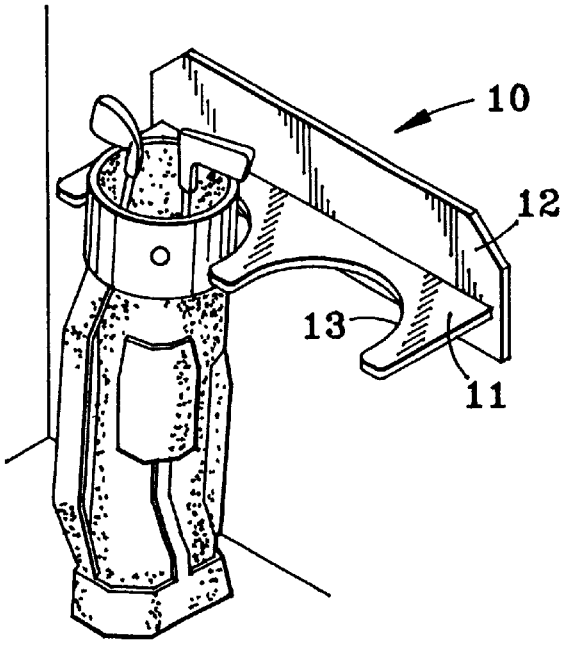
FIG. 1 shows a perspective view of a golf equipment support rack constructed in accordance with the present invention.

In the following description, like reference characters designate like or corresponding parts throughout the several views. Also, it is to be understood that such terms as "right", "left", "inside", "outside", "top", "bottom", "upright", and the like are words of convenience and are not to be construed as limiting terms. Referring in more detail to the drawings, the invention will now be described.

As best seen in FIG. 1, there is illustrated a golf equipment support rack, generally designated 10, which is constructed in accordance with the present invention. Rack 10, which is shown in FIG. 1 mounted on an indoor wall, supports a golf bag in an upright position. Rack 10 comprises: 1) a backboard 12; to which is affixed 2) a shelf 11, the shelf comprising one or more C-shaped cut-outs 13, each C-shaped cut-out being capable of accommodating a golf bag; and 3) one or more support arms extending from the backboard underneath the shelf 11.

The shelf 11 is preferably affixed to the backboard 12 at approximately a right angle. By "right angle" is meant approximately 90 degrees. In FIG. 1, the shelf 11 comprises two C-shaped cut-outs 13 for supporting one or two golf bags. The racks of the present invention preferably support between one and six conventional-size golf bags. The present support racks preferably comprise between two and six support arms.

The rack 10 of FIG. 1 is shown mounted on an interior wall at a level high enough from floor level to provide support for a golf bag. For the average golf bag, the rack should be mounted between about 25 and 35, more preferably between about 29 and 31, inches from the floor to the shelf 11 of the support rack. The top of the golf bag preferably rests against the C-shaped cut-out 13.

Figure 2:
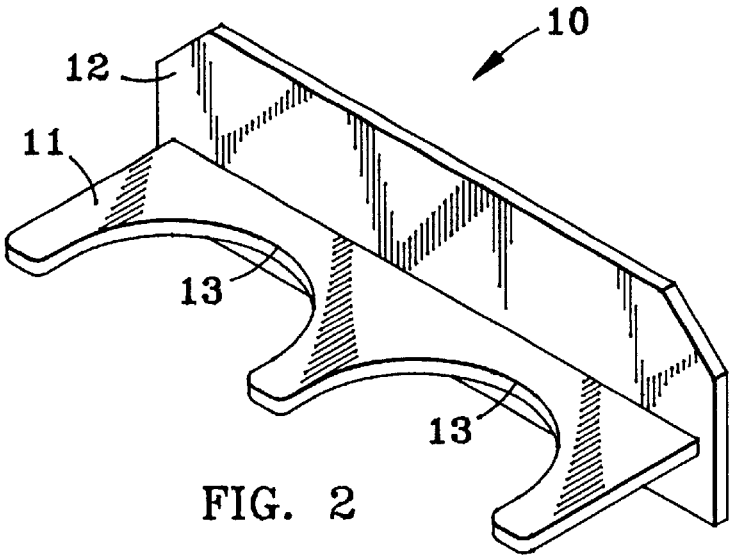
FIG. 2 shows a perspective view of the support rack shown in FIG. 1.
Figure 3:
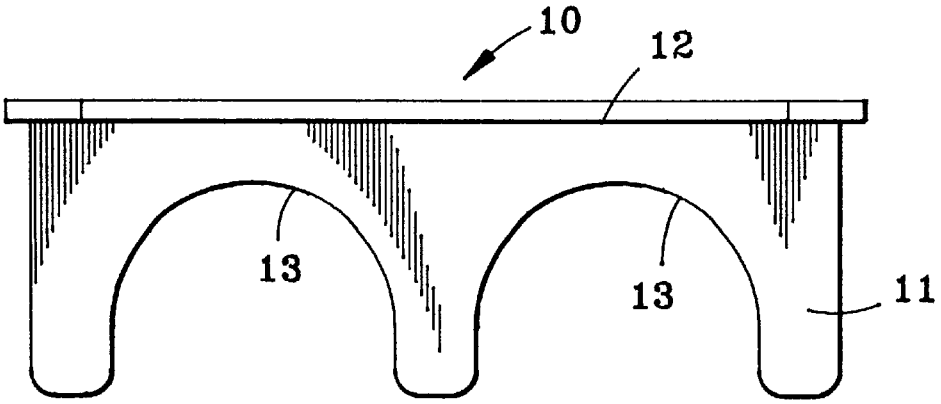
FIG. 3 shows a top plan view of the support rack shown in FIG. 1.

FIG. 2 shows another perspective view of this "two-bag" embodiment, and FIG. 3 shows a top plan view. FIG. 3 clearly shows the C-shaped cut-outs 13 in the shelf 11. The golfer simply places the golf bag into a C-shaped cut-out 13. The C-shaped cut-out 13 holds the golf bag away from the wall, which minimizes or eliminates scuffing of the wall. There is therefore no need for a base on the rack 10. The backboard 12 helps to prevent marking of the wall at the top by the golf clubs in the golf bag. The golf bag is held upright for easy removal by the golfer. Spilling of the contents of the golf bag on the ground is thus reduced.

Figure 4:
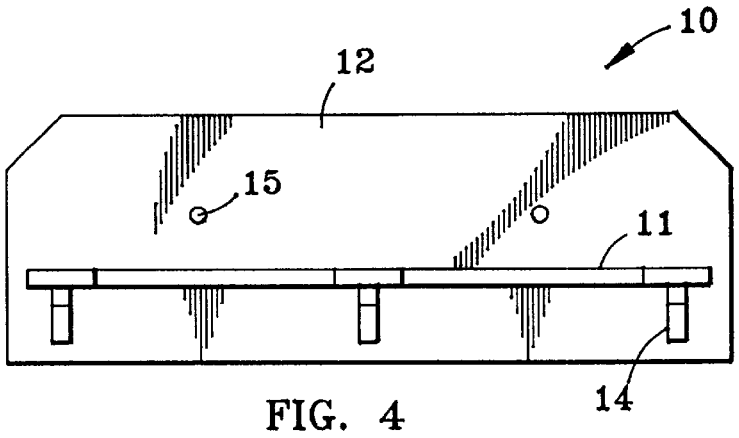
FIG. 4 shows a front view of a support rack constructed in accordance with the present invention, which has stationary support arms.

FIG. 4 shows a front view of a support rack constructed in accordance with the present invention, which has stationary support arms 14. The rack 10 is capable of supporting one or two golf bags. It is mounted on a wall by placing screws into the wall, preferably at a wall stud, through apertures 15 in the backboard, preferably above or below the shelf (or both). The support rack is preferably mounted on an interior wall using sheetrock screws. The present rack is wall-mounted and not free-standing.

Figure 5:
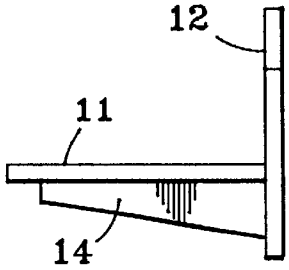
FIG. 5 shows a right side elevational view of the support rack shown in FIG. 4.

FIG. 5 shows a right side elevational view of the support rack shown in FIG. 4. Stationary support arm 14 supports the shelf 11 at a right angle to the backboard 12, so that the weight of the golf bag(s) can be placed against the shelf. It is not necessary that the rack be slanted back in order to support the golf bag.

Figure 6:
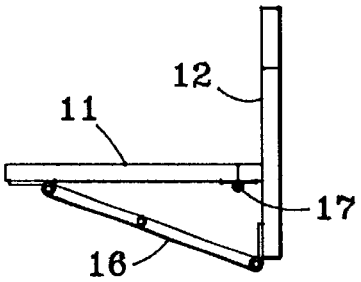
FIG. 6 shows a side view of another embodiment of a support rack constructed in accordance with the present invention, which has collapsible support arms.
Figure 7:
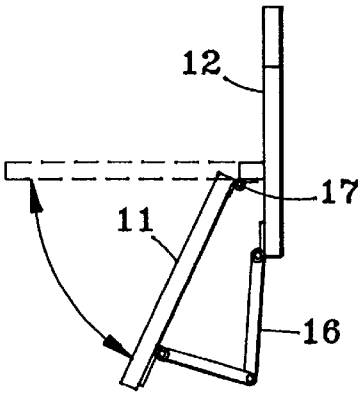
FIG. 7 shows the side view of FIG. 6 with the support arm collapsing.

A preferred embodiment is shown in FIG. 6, which shows a side view of a collapsible support rack constructed in accordance with the present invention, such as the rack shown in FIG. 2. The shelf 11 is hinged and capable of collapsing along its length. FIG. 6 shows a collapsible support arm 16 in a locked position. FIG. 7 shows the support arm collapsing and the shelf 11 being lowered. The portion of the shelf 11 extending beyond the hinge 17 folds down. The shelf 11 can be collapsed during periods when the support rack will not be in use. This is useful for increasing the amount of space available in the area, e.g. where the support rack is in a hall or entryway. It also reduces the chances that a passerby will collide with the support rack when it is in an extended position. For example, the support rack could be collapsed when small children are expected to visit. The collapsed shelf also presents a neat appearance.

Figure 8:
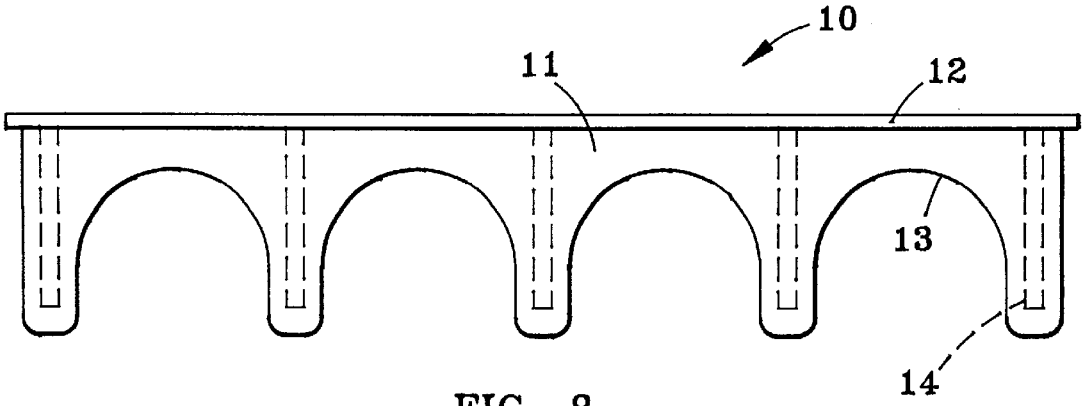
FIG. 8 shows a top plan view of another embodiment of a support rack constructed in accordance with the present invention, which is capable of supporting between one and four golf bags.

FIG. 8 shows a top plan view of another embodiment of a support rack constructed in accordance with the present invention, which is capable of supporting between one and four golf bags. This "four-bag" embodiment requires more wall space than the "two-bag" embodiment and puts more weight on the wall on which it is mounted. It is particularly useful in, for example, a golf villa, clubhouse, or motel room. The shelf 11, backboard 12, C-shaped cut-outs 13, and support arms 14 are shown.

Figure 9:
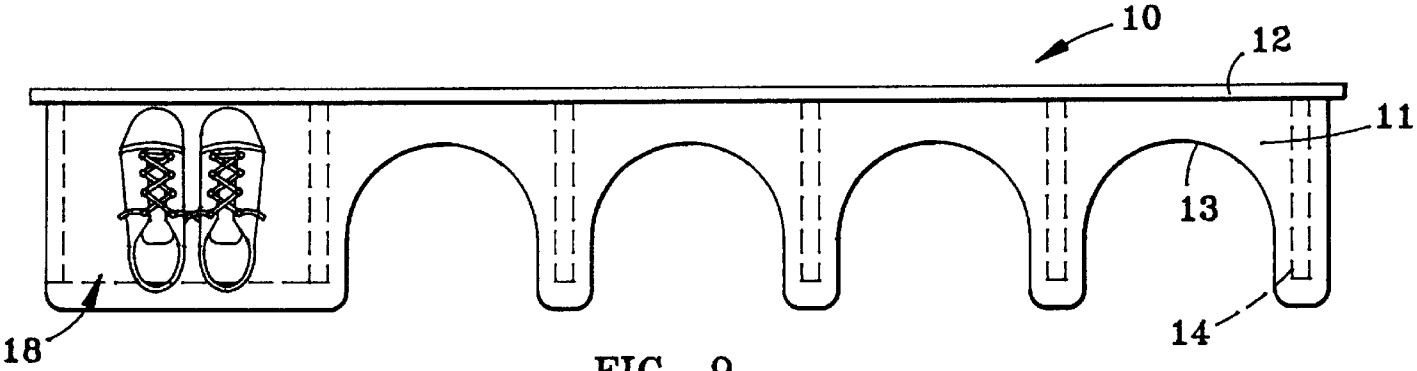
FIG. 9 shows a top plan view of another embodiment of a support rack constructed in accordance with the present invention, which is capable of supporting between one and four golf bags and accessories.

FIG. 9 shows a top plan view of another embodiment of the present invention, which is capable of supporting between one and four golf bags. On one end of the rack 10 is an accessories holder 18. The accessories holder 18 is attached to the backboard 12, preferably at a right angle. A pair of golf shoes is shown on the upper shelf of the accessories holder 18. Four stationary support arms 14 beneath the shelf 11 are also shown in FIG. 9.

Figure 10:
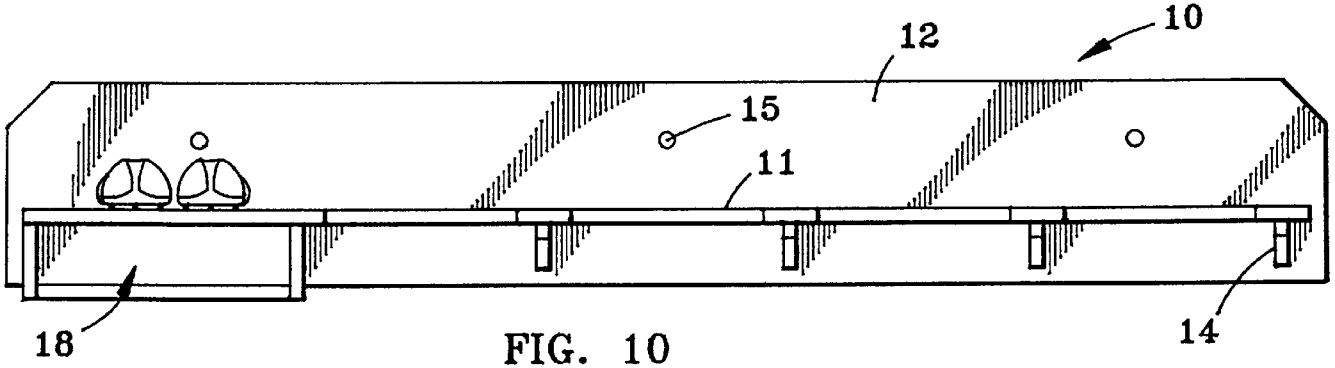
FIG. 10 shows a front elevational view of the support rack shown in FIG. 9, which includes an accessories holder.

FIG. 10 shows a front elevational view of the support rack of FIG. 9. As is shown, the accessories holder is a box-like member with two shelves: an open top shelf and a partially enclosed bottom shelf. The shelves would preferably be lined with pieces of indoor-outdoor carpet. The accessories holder 18 is for storing golf-related accessories, preferably golf shoes. Golf tees, golf balls, bug repellent, and other golf accessories can also be stored there. The accessories holder 18 is preferably large enough to accommodate two pairs of golf shoes, side by side, on one of its shelves, and miscellaneous golf-related accessories on the other shelf. Four support arms 14 beneath the shelf 11 are also shown in FIG. 10, as are apertures 18 for mounting the support rack to a wall. The present support racks may comprise one or more apertures 18 in the backboard 12 through which screws can be placed to mount the rack to a interior or exterior wall, or the rack can be mounted by other conventional means. One or more pegs (not shown) can optionally be placed underneath the shelf 11 for holding, for example, caps or visors.

Figure 11:
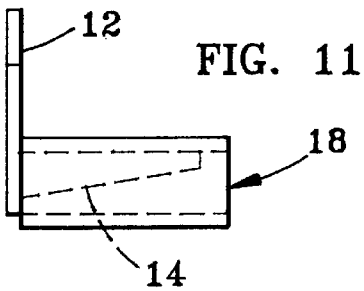
FIG. 11 shows a left side elevational view of the support rack shown in FIG. 9.

FIG. 11 shows a left side elevational view of the support rack shown in FIG. 9. A stationary support arm 14 is affixed to the backboard 12 inside the accessories holder 18.

Golf equipment support racks of the present invention can be made of any suitable material, but are preferably substantially comprised of wood or plastic. Wood is more preferred and birchwood is most preferred. The rack is preferably used indoors, in which case the wood is preferably stained and varnished. The trim on the support rack is preferably routed and painted to present an attractive appearance, particularly for use indoors.

Golf equipment support racks of the present invention are preferably made from a suitable material which is from about ¼ to about 2, more preferably from about ½ to about 1, most preferably ¾, inches in width. The backboard 12 of the present invention is preferably between about 6 and about 96, more preferably between about 8 and about 48, most preferably between about 10 and about 14, inches in height. The shelf 11 of the present invention is about the same height as the backboard 12. C-shaped cut-outs 13 are placed evenly along the shelf material during manufacture of the rack to accommodate the golf bags. The C-shaped cut-out is preferably between about 9 and about 18, more preferably between about 11 and about 12, inches at its widest point (side to side), and between about 6 and about 8 inches deep (back to front). The number of C-shaped cut-outs made, and the length of the backboard and shelf, depend upon the number of golf bags to be accommodated by the support rack. Two and four bag models are preferred.

The backboard 12 is preferably between about 26 and about 40, more preferably between about 28 and about 32, inches in length for a two-bag model, and between about 56 and about 70, more preferably between about 58 and about 62, inches in length for a four bag model without an accessories holder. In general, the backboard 12 is vertically disposed and the shelf 11 is horizontally disposed.

A two-bag model of the present invention preferably comprises from about two to four support arms, and a four-bag model preferably comprises from about two to six support arms. The support arms are preferably from about 6 to about 14, more preferably about 10, inches in length. As in FIG. 6, collapsible support arms 16 are preferably attached at their "lower" end to the lower portion of the backboard 12 and at their "upper" end to the bottom of the shelf 11.

On the two-bag collapsible model of the present invention, there are preferably two collapsible support arms 16, both of which should be collapsed in order to lower the shelf 11. The preferred collapsible shelf 11 is affixed to the backboard 12, by a hinge running parallel and close to the backboard 12. The hinge 17 is placed along the bottom of the shelf 11 about one to four inches from the point of attachment of the shelf 11 to the backboard 12. A piano hinge is preferred, preferably from about 20 to about 26, more preferably about 24, inches long for the two-bag model without an accessories holder. For a two-bag model with an accessories holder, a preferred piano hinge is from about 44 to about 52, most preferably about 48, inches in length. Generally, when the shelf 11 is collapsed, it moves from a right angle position down to a position which is approximately parallel to the backboard 12. The collapsible support arms 16 and hinge 17 are made of conventional materials.

The rack 10 is preferably substantially comprised of wood, plastic or metal. It can be made of plastic-coated wire, but is most preferably made of wood.

The optional accessories holder 18 adds inches to the length of the golf equipment support rack, if it is added on the end of the rack next to the C-shaped cut-outs, as is preferred herein. The accessories holder 18 is preferably between about 14 and about 26, more preferably between about 19 and about 21, inches in length, and is preferably about the same width as the shelf 11. The accessories holder 18 is preferably a box-like shape, with the height of the "box" preferably being between about 4 and about 10, most preferably between about 7 and about 8, inches.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. A wall-mounted rack for supporting one or more golf bags in an upright position, the rack comprising:

a backboard, to which is affixed at a right angle a shelf, comprising one or more C-shaped cut-outs, each C-shaped cut-out being capable of accommodating a golf bag; and one or more arms extending from the backboard which support the shelf;

wherein the backboard is vertically disposed and the shelf is horizontally disposed;

wherein the shelf is hinged and capable of collapsing along its length;

wherein the shelf folds down along the hinge parallel to the backboard when the support arms are collapsed; and wherein the rack is without a base.

2. The rack according to claim 1, which is mounted on an interior wall of a residence at a level high enough from floor level to provide support for a golf bag.

3. The rack according to claim 2, wherein each C-shaped cut-out is between about 9 and about 18 inches at its widest point, and from about 6 to about 8 inches deep.

4. The rack according to claim 3, further comprising an accessories holder of between about 14 and about 26 inches in length, and about the same width as the shelf.

5. A wall-mounted rack which supports between one and six conventional-size golf bags in an upright position, the rack being substantially comprised of wood, plastic, or metal, and comprising:

a backboard, to which is affixed at a right angle a shelf, comprising one or more C-shaped cut-outs, each C-shaped cut-out being capable of accommodating a golf bag;

between two and six collapsible or stationary arms which support the shelf, the support arms extending from the backboard; and an accessories holder for the storage of golf-related accessories; and wherein the backboard is vertically disposed and the shelf is horizontally disposed;

wherein the backboard is between about 8 and about 48 inches in height, and the shelf is about the same height;

wherein the shelf is hinged and capable of collapsing along its length;

wherein the shelf folds down along the hinge parallel to the backboard when the support arms are collapsed; and wherein the rack is without a base.

6. The rack according to claim 5, which is mounted on an interior wall of a residence at a level high enough from floor level to provide support for a golf bag.

* * * * *